United States Patent [19]

Klein

[11] Patent Number: 5,044,051

[45] **Date of Patent: * Sep. 3, 1991**

[54] PAIRER AND HOLDER FOR SOCK PAIRS, AND A METHOD OF PAIRING AND HOLDING SOCK PAIRS

[76] Inventor: Milton L. Klein, 30 E. 208th St., Bronx, N.Y. 10467

[ * ] Notice: The portion of the term of this patent subsequent to Jul. 10, 2007 has been disclaimed.

[21] Appl. No.: 583,729

[22] Filed: Sep. 17, 1990

[51] Int. Cl.[5] ..... A41F 1/00

[52] U.S. Cl. ..... 24/590; 24/694; 24/573.5

[58] Field of Search ..... 24/573.1, 573.5, 573.7, 24/590, 694, 549

[56] References Cited

U.S. PATENT DOCUMENTS

| | | | |
|---|---|---|---|
| 131,879 | 10/1872 | Jarboe | 24/590 |
| 1,410,770 | 3/1922 | Silverman et al. | 24/590 |
| 1,738,371 | 12/1929 | Jenckes | 24/590 |
| 1,795,674 | 3/1931 | Potter | 24/590 |
| 1,873,699 | 8/1932 | Danenberg | 24/590 |
| 1,936,378 | 11/1933 | Carr | 24/590 |
| 3,309,096 | 3/1967 | Inka | 24/573.1 |
| 4,246,679 | 1/1981 | Monett | 24/590 |
| 4,939,823 | 7/1990 | Klein | 24/590 |

*Primary Examiner*—Victor N. Sakran
*Attorney, Agent, or Firm*—Bernard J. Murphy

[57] ABSTRACT

The pairer and holder has a nylon loop which has ends thereof joined to swivel couplings. Beads of the couplings are journalled in given chambers in sections of a clasp. Other chambers in the clasp sections have, respectively, a threaded screw, with a projecting end, and a threaded bore. The projecting end of the screw is received in the bore to close the loop. The method of the invention specifies forming holes in sock pairs to receive the projecting end of the screw, and a leading end of the screw-supporting section, whereupon the screw is threaded into the bore. Hence, the holed sock pairs are held together by the pairer and holder.

8 Claims, 1 Drawing Sheet

FIG. 1
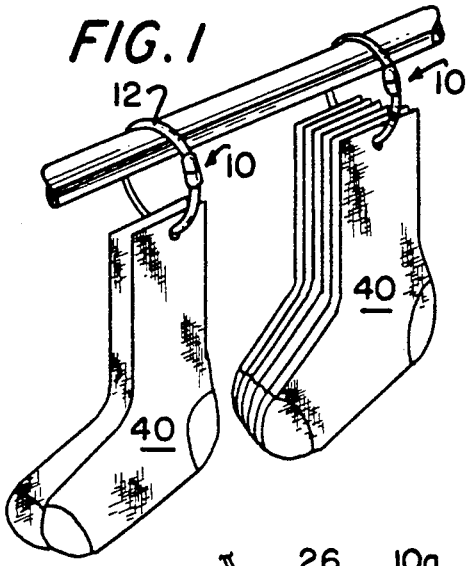
FIG. 3
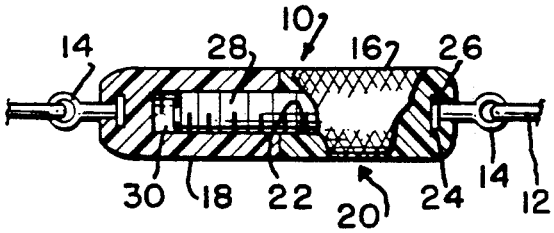
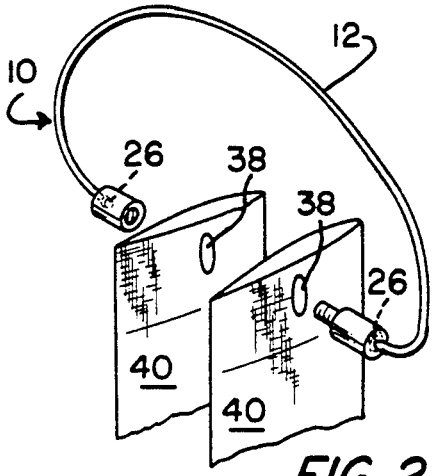
FIG. 2
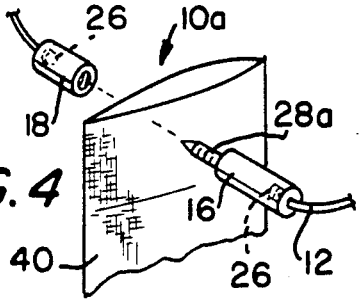
FIG. 4
FIG. 5
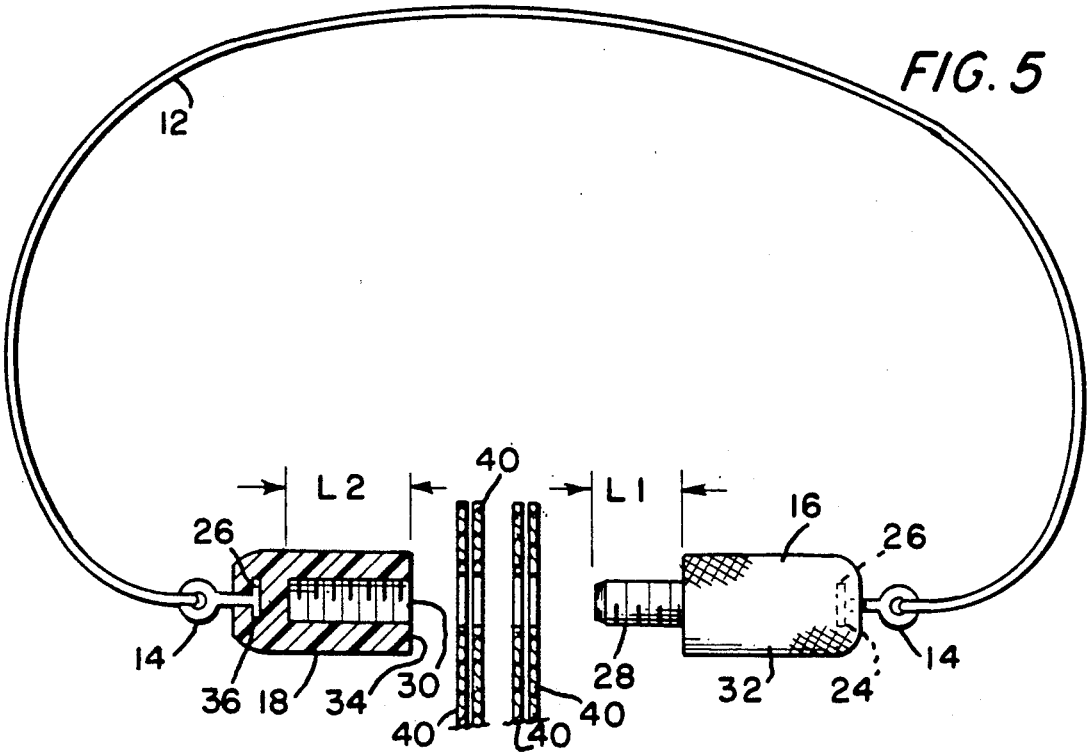

PAIRER AND HOLDER FOR SOCK PAIRS, AND A METHOD OF PAIRING AND HOLDING SOCK PAIRS

This invention pertains to means and methods of securing pairs of socks together, particularly during washing thereof, but also for retail sales display or the like.

Pairs of socks often become separated when placed with a wash load of other apparel, and all too frequently, one sock of a pair will become lost. Knotting the pairs together is done, but this is not wholly satisfactory. The knot is either too loose, so that the socks separate anyhow, or it too tight making it difficult to separate the pair after the washing, and maring the sock appearance.

In my earlier U.S. Pat. No. 4,939,823, I set forth a novel Sock Pairer and Holder of unique utility. The instant application comprises improvements thereon which were not embraced by the aforesaid patent which issued on 10 July 1990.

It is an object of this invention to set forth a pairer and holder for sock pairs comprising a dual-ended, wash-resistant loop; and a clasp for securing ends of said loop together; wherein said clasp comprises a pair of sections; each of said sections has a first chamber therewithin; and including a threaded screw, partially confined in said first chamber in one of said sections; a portion of said screw projects, through a given length, from said one section; said first chamber in the other of said sections is internally threaded to receive said portion of said screw threadedly and confiningly therein, and has a length greater than said given length; confronting ends of said sections, which abuttingly close upon each other upon said screw portion being fully threaded into said first chamber of said other section, are flat; and further including swivel couplings joined to said sections and said ends of said loop; each of said swivel couplings having a bead; and wherein said sections further have second chambers therewithin; and said beads are rotatably journalled in said second chambers in isolation from said first chambers to prevent wash water and detritus from entering said first chamber of said one section and reaching said screw.

Further objects of this invention, as well as the novel features thereof, will become more apparent by reference to the following description, taken in conjunction with the accompanying figures, in which:

FIG. 1 is a perspective view of two sock pairers, according to an embodiment of the invention, hanging from a bar with socks attached.

FIG. 2 is a view of the sock pairer ready to be inserted into preformed holes in sock of a pair, according to the novel method.

FIG. 3 is a partially cross-sectioned illustration of the closed clasp and the swivel couplings.

FIG. 4 is a view similar to that of FIG. 2, albeit depicting an alternative embodiment of the invention in which the screw has a pointed end for piercing sock pairs which have no pre-formed holes therein.

FIG. 5 is a partially cross-sectioned view, similar to that of FIG. 3, but showing the clasp open, a full loop, and a fragmentary pair of socks.

As shown in FIGS. 1 through 3 and 5, the novel pairer and holder for sock pairs 10 comprises a nylon cord 12 which has the ends thereof joined to nylon swivel couplings 14. The swivel couplings are journalled in sections 16 and 18 of a clasp 20.

Section 16 has first and second chambers 22 and 24, respectively, therewithin. Chamber 24 has the bead 26 of one of the swivel couplings 14 rotatably captive therein, and chamber 22 has a threaded screw 28 fixed therein. A portion of the screw 28 projects outwardly, from section 16, for a length L-1. Said projecting portion of the screw 28 is threadedly received in a first chamber 30 in the section 18 of the clasp 20. Chamber 30 is threaded, and has a length L-2 which is greater than length L-1. Confronting ends 32 and 34 of the sections 16 and 18, which sections are formed of plastic, are flat. Consequently, if the screw 28 can be fully received in the chamber 30, the flat, confronting ends 32 and 34 will close upon each other, and form a tight interface thereat to prevent wash water or detritus from reaching the screw 28. It is for this reason that the chamber 30 has a greater length than the projecting portion of the screw 28; this insures that the ends 32 and 34 can be made to close tightly against each other, to form a sealed interface.

Section 18, like section 16, also has a second chamber 36 in which the bead 26 of the other swivel coupling 14 is similarly rotatively captive.

It is particularly to be noted that chambers 22 and 24 are isolated from each, as are chambers 30 and 36. This significant feature insures that no wash water or detritus can enter the first chamber 30 of section 18 and reach the screw and, consequently, the screw 28 can be made of an inexpensive grade of steel, as it will not be subject to rusting. The isolation of the chambers, as aforesaid, as well as the sealed interface of ends 32 and 34 make this so. In any event, even where the screw 28 is formed of material not subject to rusting, it is desirable for the screw 28 to be sealed off from the chambers 36 (and 24) to insure that no threads, from fabrics, or soap and/or detergent deposits reach the screw 28 and the threads of the chamber 30 and the screw 28. Such would make it difficult to use the pairer and holder 10. Chamber 30 and the screw 28 would require repetitive and tiresome cleansing, as well.

The invention comprehends forming holes 38 in sock pairs, as shown in FIG. 2, in uppermost areas of the socks (as such are customarily obscured when worn). Then the screw 28, and the leading end of the section 16, are passed through the holes. Finally, the screw 28 is made fast in the chamber 30. Thusly, sock pairs are secured together for washing, or display in retail establishments.

The embodiment of the invention depicted in FIG. 4 is similar in all respects to the pairer and holder 10, except that therein the pairer and holder **10*a* has a screw 28*a* with a pointed end. Clearly, as shown, this is for use in pairing socks which have no holes 38 performed therein. The pointed end of the screw 28*a* simply pierces the uppermost areas of the socks 40**.

While I have described my invention in connection with specific embodiments thereof, and a given method of practice, it is to be clearly understood that this is done only by way of example, and not as a limitation to the scope of the invention, as set forth in the objects thereof and in the appended claims. For instance the swivel couplings can comprise simply the beads 26 secured to the ends of the loop or cord 12, as shown, in phantom, in FIGS. 2 and 4. Too, the use of the invention is not limited, clearly, to the pairing, holding and- /or display of socks. It lends itself to other apparel as well.

I claim:

1. A pairer and holder for sock pairs during washing, comprising:

a dual-ended, wash-resistant loop; and a clasp for securing ends of said loop together; wherein said clasp comprises a pair of sections;

each of said sections has a first chamber therewithin; and including a threaded screw, partially confined in said first chamber in one of said sections;

a portion of said screw projects, through a given length, from said one section;

said first chamber in the other of said sections is internally threaded to receive said portion of said screw threadedly and confiningly therein, and has a length greater than said given length;

confronting ends of said sections, which abuttingly close upon each other upon said screw portion being fully threaded into said first chamber of said other section, are flat; and further including swivel couplings joined to each of said sections and to said ends of said loop;

each of said swivel couplings have a bead; and wherein said sections further have second chambers therewithin; and said beads are rotatably journalled in said second chambers in isolation from said first chambers to prevent wash water and detritus from entering said first chamber of said one section and reaching said screw.

2. A pairer and holder for sock pairs during washing, according to claim 1, wherein:

said sections are formed of plastic.

3. A pairer and holder for sock pairs during washing, according to claim 1, wherein:

said loop and said swivel couplings are formed of nylon.

4. A pairer and sock holder for sock pairs during washing, according to claim 1, wherein:

said screw portion has a blunt end.

5. A pairer and holder for sock pairs during washing, according to claim 1, wherein:

said screw portion has a pointed end.

6. A method of pairing and holding sock pairs during washing, comprising the steps of:

forming holes in sock pairs in uppermost areas thereof;

securing the pairs together by means of a pairer and holder which has (a) a dual-ended, wash-resistant loop; and (b) a clasp for securing ends of said loop together; wherein said clasp comprises a pair of sections; each of said sections has a first chamber therewithin; and including a threaded screw, partially confined in said first chamber in one of said sections; a portion of said screw projects, through a given length, from said one section; said first chamber in the other of said sections is internally threaded to receive said portion of said screw threadedly and confiningly therein, and has a length greater than said given length; confronting ends of said sections, which abuttingly close upon each other said screw portion being fully threaded into said first chamber of said other section, are flat; and further including swivel couplings joined to each of said sections and to said ends of said loop; each of said swivel couplings having a bead; and wherein said sections further have second chambers therewithin; and said beads are rotatably journalled in said second chambers in isolation from said first chambers to prevent wash water and detritus from entering said first chamber of said one section and reaching said screw;

passing said screw portion and a leading end of said one section through said holes in the sock pairs; and fully threaded said screw portion into said first chamber in said other section until said flat, confronting ends of said sections are closed tightly against each other.

7. A method, according to claim 6, wherein said pairs securing step comprises:

securing the pairs with a pairer and holder, as aforesaid, in which said sections thereof are formed of plastic.

8. A method, according to claim 6, wherein said pairs securing step comprises:

securing the pairs with a pairer and holder, as aforesaid, in which said loop and said swivel couplings are formed nylon.

* * * * *